United States Patent [19]

Dunaj

[11] 3,979,824

[45] Sept. 14, 1976

[54] CAN OPENER

[76] Inventor: Raymond C. Dunaj, 601 Maple Ave., Neptune, N.J. 07753

[22] Filed: Feb. 17, 1976

[21] Appl. No.: 658,819

[52] U.S. Cl. ..... 30/21.5; 30/21
[51] Int. Cl.[2] ..... B67B 7/34
[58] Field of Search ..... 30/14–15.5, 30/17–21.5

[56] References Cited

UNITED STATES PATENTS

| | | | |
|---|---|---|---|
| 1,124,449 | 1/1915 | Hurley | 30/21 X |
| 1,603,609 | 10/1926 | Killman | 30/19 |
| 1,969,868 | 8/1934 | Wright | 30/17 |
| 3,008,231 | 11/1961 | Carponi | 30/17 |

*Primary Examiner*—Al Lawrence Smith
*Assistant Examiner*—Gary L. Smith
*Attorney, Agent, or Firm*—Charles F. Gunderson

[57] ABSTRACT

A can opener having at least two guide rollers or wheels positioned to moveably engage the underside of the lip around the top of a standard cylindrical tin can. These guide rollers are held in position by a main bracket that also holds a pivotably mounted cutter arm. The cutter arm includes a cutting device or wheel that is pushed through the top lid of the can just inside the outer lip when the cutting arm is depressed. When the cutting device has punctured the top lid of the can, the cutter arm is drawn around the periphery of the can, in one quick, easy motion to open the top of the can. The guide rollers hold the cutting device against the inside of the lip of the can and keep it penetrating through the top surface of the lid of the can throughout the operation.

8 Claims, 3 Drawing Figures

CAN OPENER

BACKGROUND OF THE INVENTION

There are almost innumerable types of can openers that have been developed to accommodate the many types of cans that have been developed as containers. Even considering round cans alone, there are probably thousands of variations. The very number of variations of can openers clearly indicates that there is no perfect can opener, and that there is a continuing need for a simple, effective, fast-operating, and relatively-economical can opener.

Considering the manual can openers alone, there are some that are attached to the cans, some that wind or grind about the top of a can, and some that are combined with other tools. There are also some that swing about the top of the can, but almost all of these require adjustment for the width of the can, and many of these cut into the outside of the can, leaving dangerously-sharp edges and more likelihood of spillage of the contents of the can. Others that swing about the can have — or need — a central pivot in the top lid to guide the cutter arm and cutting device.

It is therefore an object of this invention to provide a manual can opener that is very simple and fast in operation; that requires a minimum amount of time and motion to operate; that provides a quick and clean cut with a minimum of jagged edges and the like; and that will handle a wide variety of circular cans with uniform efficiency and without the need for adjustment for each diameter of can. It is a further object of this invention to provide a can opener that does not require electricity or electric cords and that is completely portable. To distinguish this invention from other can openers, I have called this the 'Noanie' can opener.

SUMMARY OF THE INVENTION

A manual can opener, in accordance with this invention has a main bracket portion with at least two guide rollers positioned to engage the underside of the peripheral lip on the top of a can to be opened. This main bracket also has a pivoting cutter arm with a handle that swings the arm down and a cutting wheel mounted on the cutter arm to engage the tip of the can on the inside of the peripheral lip. When the main bracket and the guide rollers are positioned to engage the underside of the peripheral lip, on the outside of the can, the handle and the cutter arm are pivoted down until the cutting wheel penetrates the top of the can inside and very close to the peripheral lip. When the handle of the cutter arm is rotated around the can, the guide rollers will follow the lip around the can to draw the cutter through the top of the can along the inside of the lip to open the top of the can and to smooth any potentially-sharp edges around the top of the can.

DESCRIPTION OF THE PREFERRED EMBODIMENT

Figure 1:
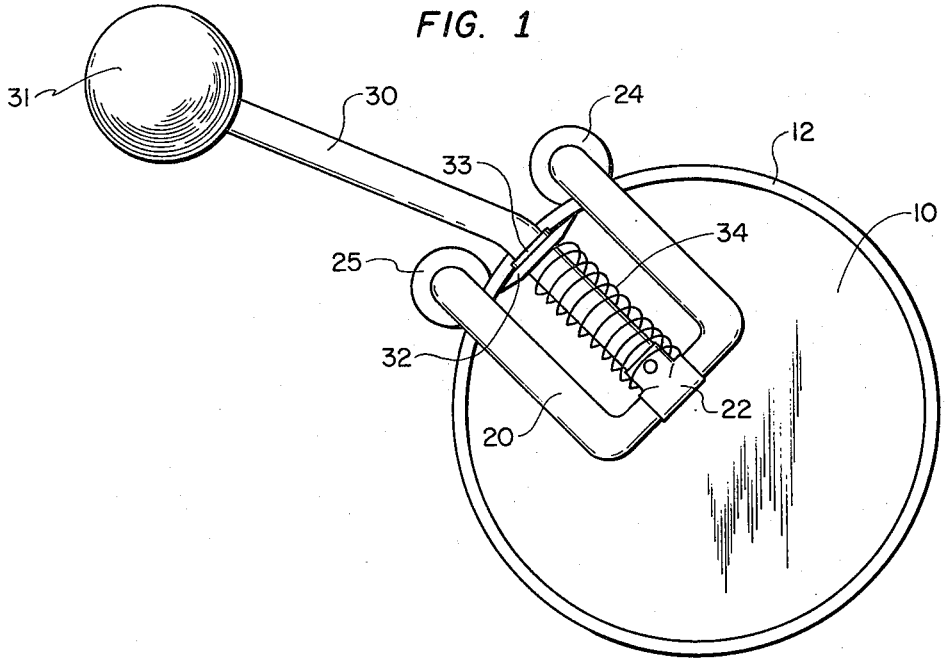
FIG. 1 shows a top view of the can opener in operation.

Referring now more particularly to FIG. 1, a can opener, in accordance with this invention is shown in its operating position with respect to a can 10 that has an upper peripheral lip 12. A main bracket 20 is U shaped, with guide rollers 24 and 25, at the extremities of the U, engaging the outside of the lip 12.

A cutter arm 30 is shown with a handle 31 at one end. The other end of the cutter arm pivots on the main bracket at 22. A cutting wheel 32 is rotatably mounted on the cutter arm, just inside of the guide rollers of the main bracket and the lip 12. A spring 34 urges the cutting wheel against the inside of the peripheral lip 12 but a collar 33 holds the cutting wheel in its normal operating position.

Figure 2:
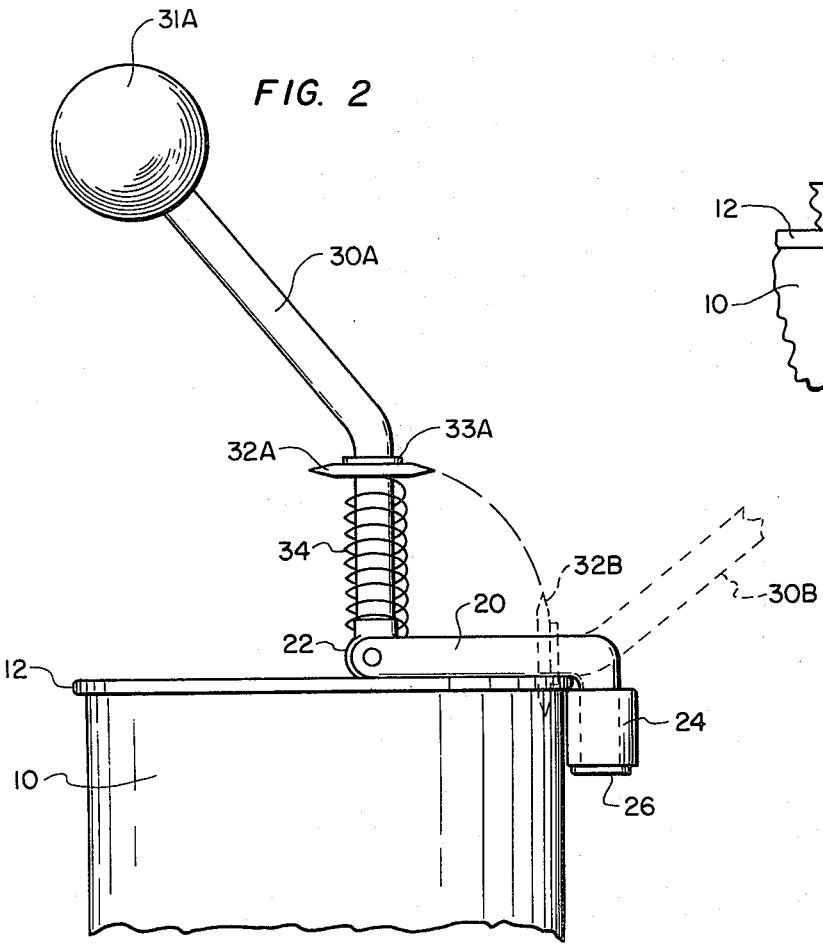
FIG. 2 shows a side view of the can opener before and during operation.

FIG. 2 shows a side view of substantially the same device, with similar elements similarly numbered. The main bracket 20 holds the guide roller 24 which pivots about one end portion of the bracket. The guide roller 24 may be held in place by a washer 26. The guide roller 25 and a corresponding washer are not seen from this angle.

FIG. 2 also shows the cutter arm in its upright position at 30A in solid lines and in its operating position at 30B in dotted lines. The cutting wheel is also seen in its upright position at 32A in solid lines and in its operating position at 32B in dotted lines.

Figure 3:
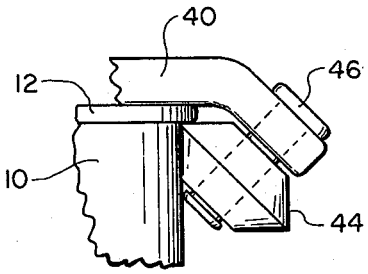
FIG. 3 shows a variation of guide rollers.

FIG. 3 shows a variation of main bracket 40 and guide roller 44. In this variation, a pivot pin 46 is used to hold the guide roller to the main bracket.

In operation, with the cutter arm in its upright position 30A of FIG. 2, the main bracket 20 is positioned on top of the can 10 so that the top surfaces of the guide rollers 24 and 25 securely engage the outer, underside of the lip 12. The cutter arm handle at 31A is then pushed downwards to the operating position of the cutter arm at 30B, whereat, the cutting wheel 32B penetrates the top of the can just inside of the lip 12.

Holding the can firmly, the handle is firmly swung around the top of the can, with the guide rollers 24 and spring 34 holding the cutting wheel outwardly against the inside of the lip of the can and downwardly so that the cutting wheel cuts through the top lid of the can during the entire swing of the handle. When the circuit is complete and the top of the can is cut open, the cutter arm can be raised, the guide rollers moved away from the lip of the can, and the can opener removed.

The guide rollers must be able to turn freely and to maintain their position under the peripheral lip of the can. However, it is obvious that considerable variation in the size and shape of the guide rollers, as well as the angle of their pivots with respect to the can and main bracket, is possible. The guide roller 44 of FIG. 3, for example, could have a relatively larger diameter and more area of contact under the lip of the can.

The placement of the guide rollers, and the shape of the main bracket can also have other variations as noted earlier. The guide rollers can be wider apart, or closer together, depending on the sizes and shapes of the cans to be opened and the force on the handle required to cut the top lid of the can. Closer spacing may increase the effective range of diameters of the cans that this can opener can accommodate, but a wider spacing may be needed to accommodate the leverage of the cutter arm when the cutting resistance is relatively high.

The cutting wheel with the collar 33 will normally be set to accommodate the smallest diameter can to be opened, and the cutting wheel will be pushed back by the inside of the lip 12, against the urging of the spring 34 as it goes into larger diameter cans. For uniform size cans, the spring will not be necessary if the force of the turning cutting arm draws the cutting wheel against the inner side of the lip as it is moved about the top of the can.

The cutter arm may be longer or shorter, as desired, and the position and shape of the handle may also be varied. The handle may be straight and nearly flush with the top of the can, or it may be tilted up, as shown in FIG. 2 and to the right — or left — as seen in FIG. 1, to accommodate either a right or a left handed person. The guide rollers may also be varied in size or position to improve use in either a right or left handed sense. However the ambidexterous potential of this can opener may be found to be more advantageous than the improvements in operation that may be possible by making it assymmetrical.

Where this can opener is being used to open tin cans that have iron content in their top lids, the lower portion of the main bracket can be magnetized, or a small magnet may be added, in any well known manner, to be attracted to the top to the can to aid in seating the main bracket and in starting the operation, and to remove the top of the can along with the can opener when the cutting operation is completed.

It is to be understood that I do not desire to be limited to the exact details of construction shown and described for obvious modifications will occur to a person skilled in the art.

What is claimed is:

1. A can opener comprising:

a moveable main bracket positioned adjacent to and substantially parallel to the top lid of a can to be opened;

at least two guide rollers rotatably secured to the outer extremities of said main bracket, each of said guide rollers having one upper surface to engage the underside of the peripheral lip between said top lid and the side of said can, and another lateral surface to engage the side of said can just under said peripheral lip;

a cutter arm having one end pivoted at the inner extremity of said main bracket;

a handle attached to the other end of said cutter arm;

a cutting mechanism attached between said one end and said other end of said cutter arm;

said cutter arm having a first position pivoted upward with said cutting mechanism clear of said top lid of said can, and a second position pivoted downward with said cutting mechanism penetrating said top lid of said can on the inside of said peripheral lip between said guide rollers;

said handle being used for rotating said cutter arm, in said second position, around said peripheral lip of said can so that said cutting mechanism can cut through said top lid of said can along the inside of said peripheral lip to open said can.

2. In a can opener as in claim 1 said cutting mechanism being in the form of a cutting wheel, pivoted on said cutter arm, and having a sharp outer edge to cut through said top lid of said can.

3. A can opener as in claim 1 wherein said cutting mechanism is fixed at a position along said cutter arm where said cutting mechanism will cut said top lid just inside of said peripheral lip.

4. A can opener as in claim 1 wherein said cutting mechanism is free to move along said cutter arm to accommodate a wider range of diameters of cans.

5. In a can opener as in claim 4, a spring device positioned between said one end of said cutter arm and said moveable cutting mechanism to urge said cutting mechanism against said peripheral lip while said can is being opened.

6. A can opener as in claim 1 wherein said guide rollers are cylindrical with a flat upper end, substantially parallel with the plane of said top lid, providing said one surface to engage said underside of said peripheral lip, and a cylindrical outer surface providing said other surface to engage said side of said can.

7. A can opener as in claim 1 wherein said guide rollers have a V-shaped outer edge, and are pivoted at substantially forty-five degrees with respect to the plane of said top lid so that the upper side of said V functions as said one surface to engage said underside of said peripheral lip and the other side of said V functions as said other surface to engage said side of said can.

8. A can opener as in claim 1 wherein said main bracket is a single rod, bent in a U shape with the ends bent down to serve as pivots for said guide rollers, and said central portion serves as a pivot for said cutter arm.

* * * * *